US007784516B2

(12) United States Patent
Chen

(10) Patent No.: US 7,784,516 B2
(45) Date of Patent: Aug. 31, 2010

(54) AUTOMATIC NOSE STRIP BONDING APPARATUS FOR FACE MASK

(76) Inventor: Hung-Ho Chen, 1/F., No. 19, Alley 7, Lane 195, Yung Feng Rd., Tu Cheng City, Taipei (TW)

( * ) Notice: Subject to any disclaimer, the term of this patent is extended or adjusted under 35 U.S.C. 154(b) by 784 days.

(21) Appl. No.: 11/735,494

(22) Filed: Apr. 16, 2007

(65) Prior Publication Data

US 2008/0251210 A1 Oct. 16, 2008

(51) Int. Cl.
*B32B 38/04* (2006.01)
*B05C 5/02* (2006.01)

(52) U.S. Cl. ..... 156/517; 156/475; 156/521; 156/578; 414/20; 128/206.28

(58) Field of Classification Search ..... 156/517, 156/521, 539, 543, 556, 578, 475, 256; 128/206.28; 414/20; 198/377.03, 377.07; 271/239
See application file for complete search history.

(56) References Cited

U.S. PATENT DOCUMENTS 3,955,481 A * 5/1976 Heitmann ..... 493/8
4,300,549 A * 11/1981 Parker ..... 128/206.19
5,842,470 A * 12/1998 Ruben ..... 128/206.19
6,179,602 B1 * 1/2001 Eakin ..... 425/305.1

* cited by examiner

*Primary Examiner*—Kat Wyrozebski
*Assistant Examiner*—Scott W Dodds
(74) *Attorney, Agent, or Firm*—Leong C. Lei

(57) ABSTRACT

An automatic nose strip bonding apparatus for a face mask is disclosed, including a nose strip providing mechanism, a nose strip turnover mechanism, and a press-to-bond device. The nose strip providing mechanism drives a nose strip forward and carries out stamping operation on the nose strip, and applies a bonding agent to the nose strip. The nose strip turnover mechanism serves to turn over the nose strip that has already been applied with the bonding agent to allow the surface of the nose strip on which the bonding agent is applied to face a face mask. The press-to-bond device includes a first bonding device and a second bonding device to attach the nose strip to the face mask and to carry out a secondary bonding operation, respectively, to ensure firm bonding of the nose strip to the face mask.

9 Claims, 19 Drawing Sheets

AUTOMATIC NOSE STRIP BONDING APPARATUS FOR FACE MASK

BACKGROUND OF THE INVENTION (a) Technical Field of the Invention

The present invention relates to an apparatus for bonding a nose strip to a face mask, and in particularly to an apparatus that employs automation machines to carry out automatic bonding operation for bonding a nose strip to a face mask.

(b) Description of the Prior Art

A face mask is often put on the face of a wearer to cover the nose and mouth. The bridge of the nose that raises above the face easily causes a gap between the mask and the wearer's face. Thus, the performance of filtration of air by the mask is significantly impaired. In addition, the hot air breathed out of the nose escape through the gap and rushing toward the eyes. In case that the mask wearer also wears a pair of eyeglasses, the hot air or vapor contained therein will be caused to condensate on the cold eyeglasses. This causes problems for correctly seeing object for the wearer.

To solve the problem, a nose strip is attached to the face mask at a location corresponding to the nose bridge. The nose strip, preferably made of metal wires, is deformable to comply with the contour of the wearer's face so as to eliminate the gap between the mask and the wearer's face. The known face mask that is provided with a nose strip, however, has a very complicated manufacturing process as compared to the traditional nose-strip-free mask and requiring more labor. Thus, the nose-strip-attached mask has substantially higher manufacturing costs.

Thus, the present invention is aimed to overcome the above discussed problems by providing an apparatus capable of a simply and continuous process for manufacturing a face mask with nose strip.

SUMMARY OF THE INVENTION

The primary purpose of the present invention is to provide an automatic apparatus that requires reduced human labor while increasing the throughput of face mask. Further, the nose strip can be made of metal wires. The automatic apparatus in accordance with the present invention comprises a nose strip providing mechanism, a nose strip turnover mechanism, and a press-to-bond device. The nose strip providing mechanism comprises at least one strip driving roller, a cutting module, a strip forwarding slider, and a bonding agent sprayer. The strip driving roller drives a nose strip forward to the cutting module, to a predetermined length, to allow the cutting module to perform stamping operation on the nose strip. And the chip generated in the stamping operation is discharged through a chip chute. The stamped nose strip is then further carried forward by the strip forwarding slider and when the nose strip is moved through the bonding agent sprayer, an bonding agent is applied to the nose strip to allow the nose strip to be attached to a face mask. The nose strip forwarding slider comprises a first stationary clamp, a second stationary clamp, and a strip positioner. The strip positioner comprises a push rod. The first and second stationary clamps serve to hold the nose strip in movement for facilitating movement of the nose strip without falling. The push rod of the nose positioner serves to depress and hold the nose strip for application of the bonding agent. The nose strip turnover mechanism comprises a strip pulling module, a first positioning rack, a reciprocating clamp, a second positioning rack, and a rotary clamp. The strip pulling module comprises a strip pulling roller, which pulls forward the nose strip that has been applied with the bonding agent. The first positioning rack forms at least one channel, which is located behind the strip pulling roller in the strip forwarding direction, whereby when the nose strip passes the strip pulling roller, the nose strip can be positioned in the channel and partially projecting beyond the channel. A guide channel is provided between the strip pulling roller and the first positioning rack. The reciprocating clamp comprises at least one fixed clip, which holds on a portion of the nose strip that projects beyond the first positioning rack for driving the nose strip. When the reciprocating clamp moves the nose strip out of the first positioning rack, the first positioning rack is rotated to allow the projecting portion of the nose strip to be positioned on the second positioning rack. The rotary clamp comprises at least one fixed clip for holding the nose strip positioned on the second positioning rack. The first bonding device comprises a first push board and a first anvil for attaching the nose strip to the face mask. The second bonding device comprises a second push board and a second anvil for pressing the nose strip once again to more firmly attaching the nose strip to the face mask.

With such mechanisms and devices, in accordance the present invention, a nose strip is prepared and supplied, cut, coated with adhesive, and pressed to bond to a face mask in a single process. And no extra labor is needed during the manufacturing process of the face mask. Thus, the automation of the face mask making apparatus in accordance with the present invention not only increases the manufacturing speed, but also enhances the product quality and reduces the manufacturing costs.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
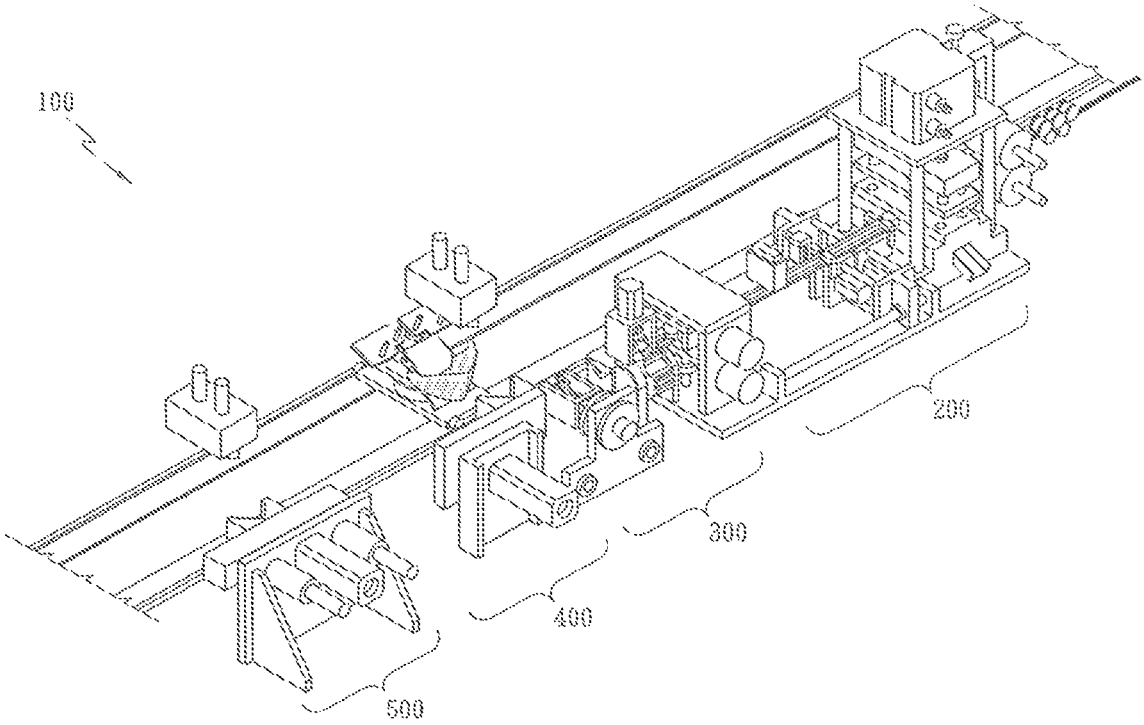
FIG. 1 is a perspective view showing an automatic nose strip bonding apparatus constructed in accordance with the present invention for bonding a nose strip to a face mask.
Figure 2A:
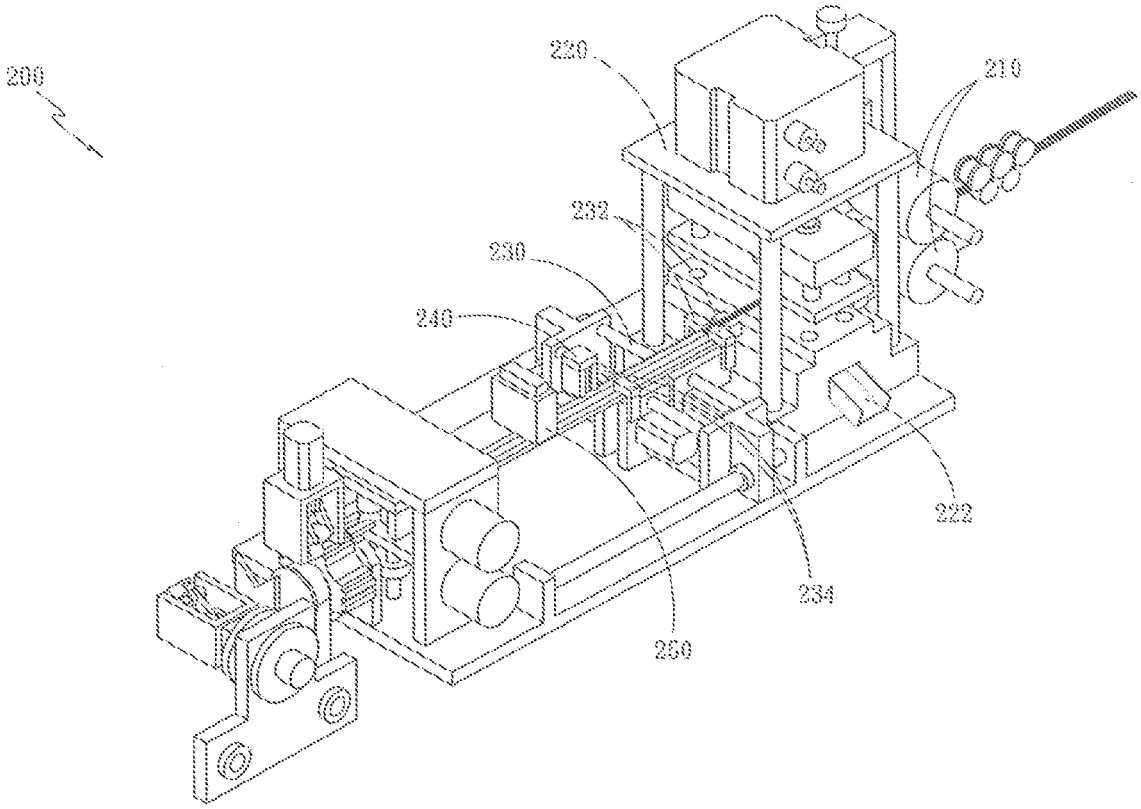
FIGS. 2A-2G are perspective views showing the operation of a nose strip providing mechanism of the automatic nose strip bonding apparatus of the present invention.
Figure 2B:
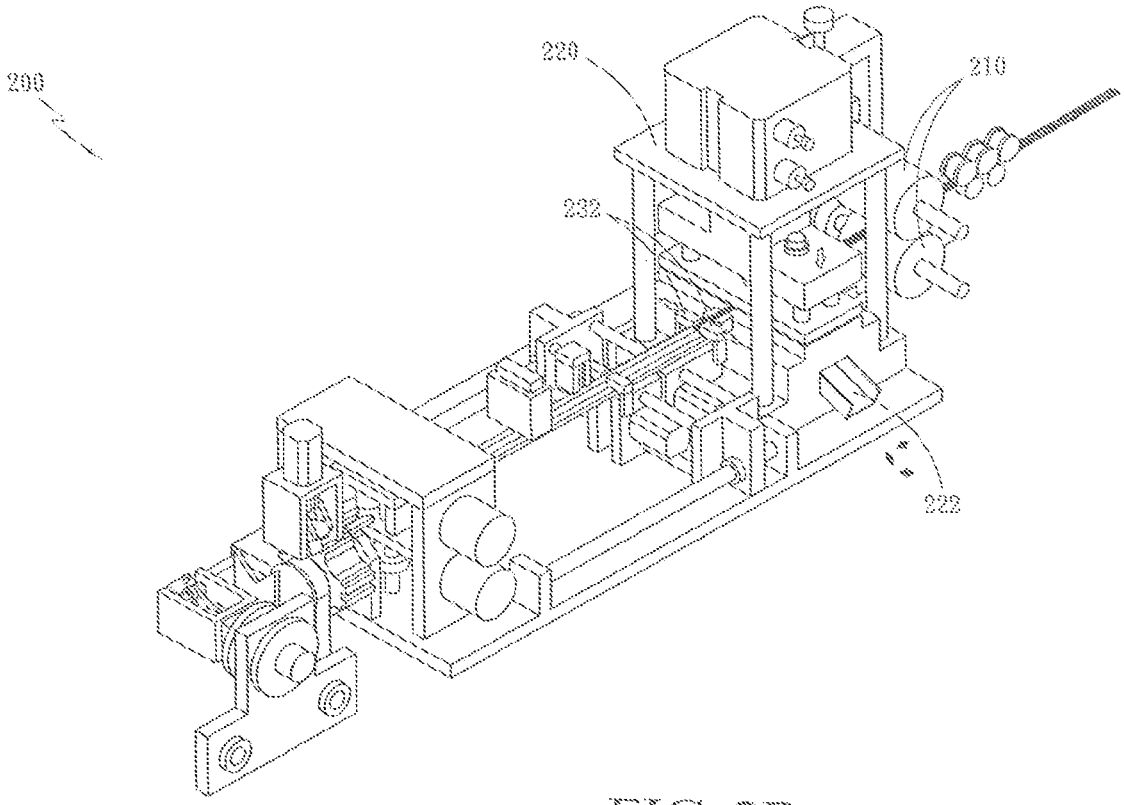
Figure 2C:
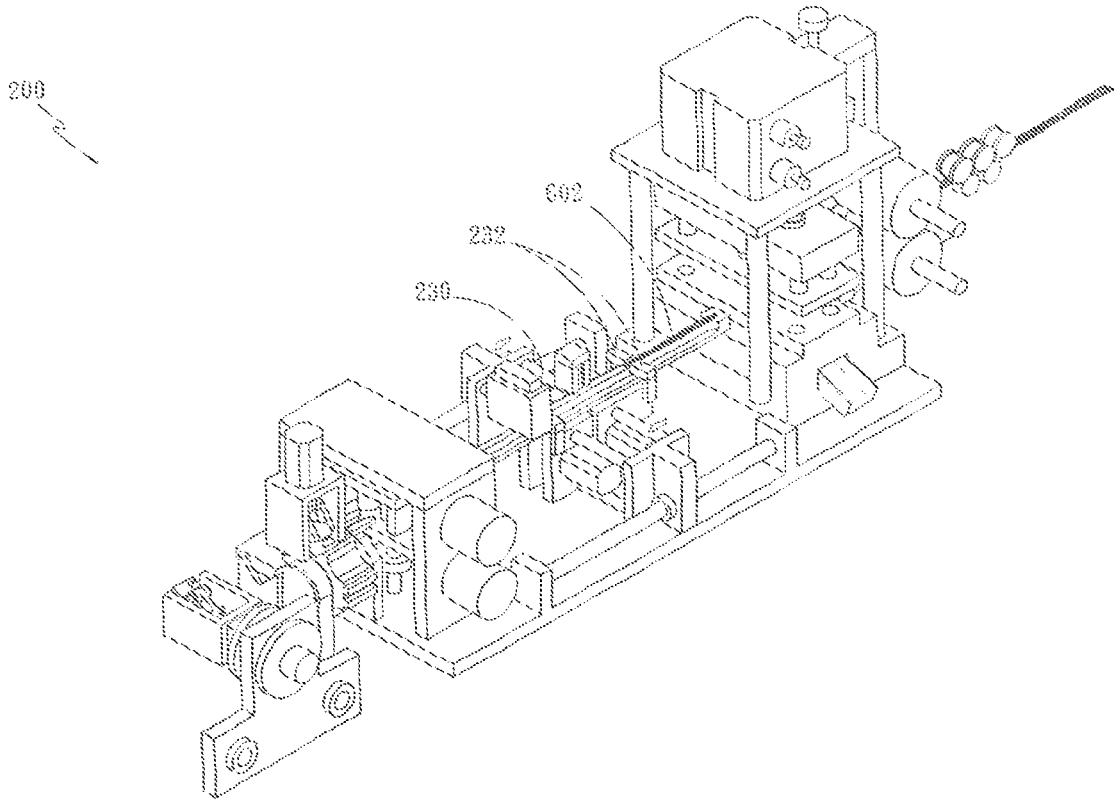
Figure 2D:
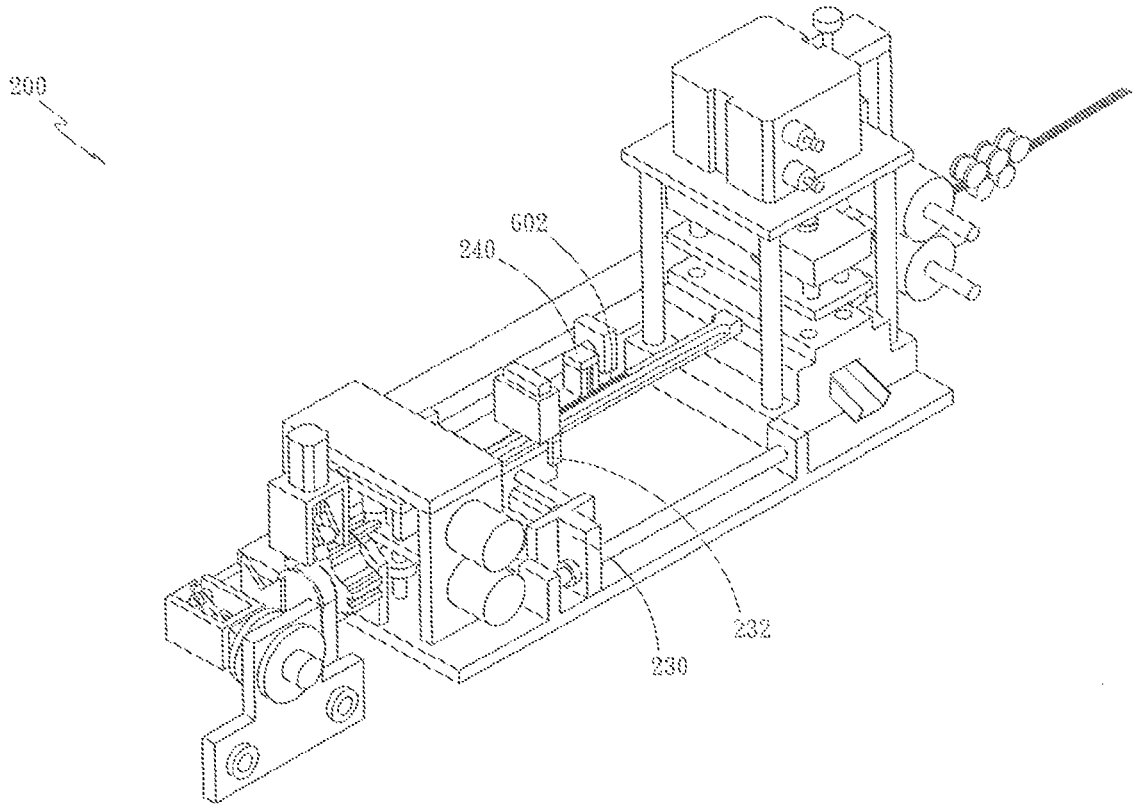
Figure 2E:
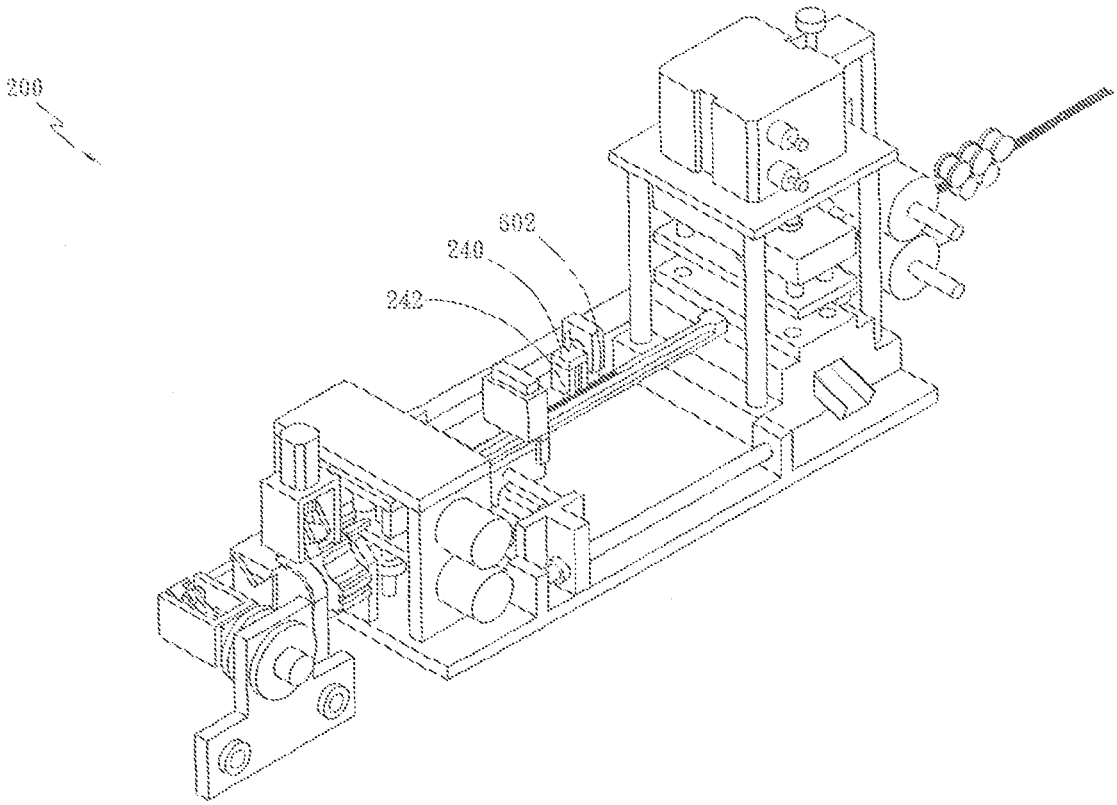
Figure 2F:
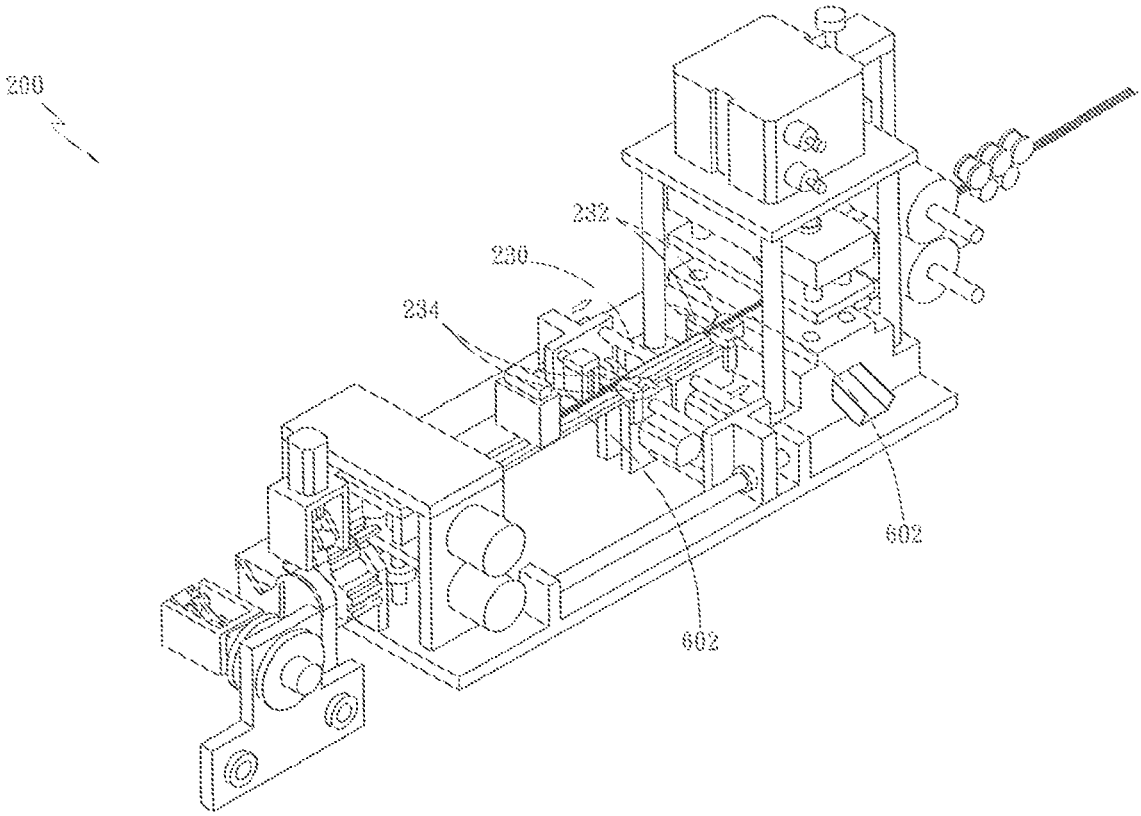
Figure 2G:
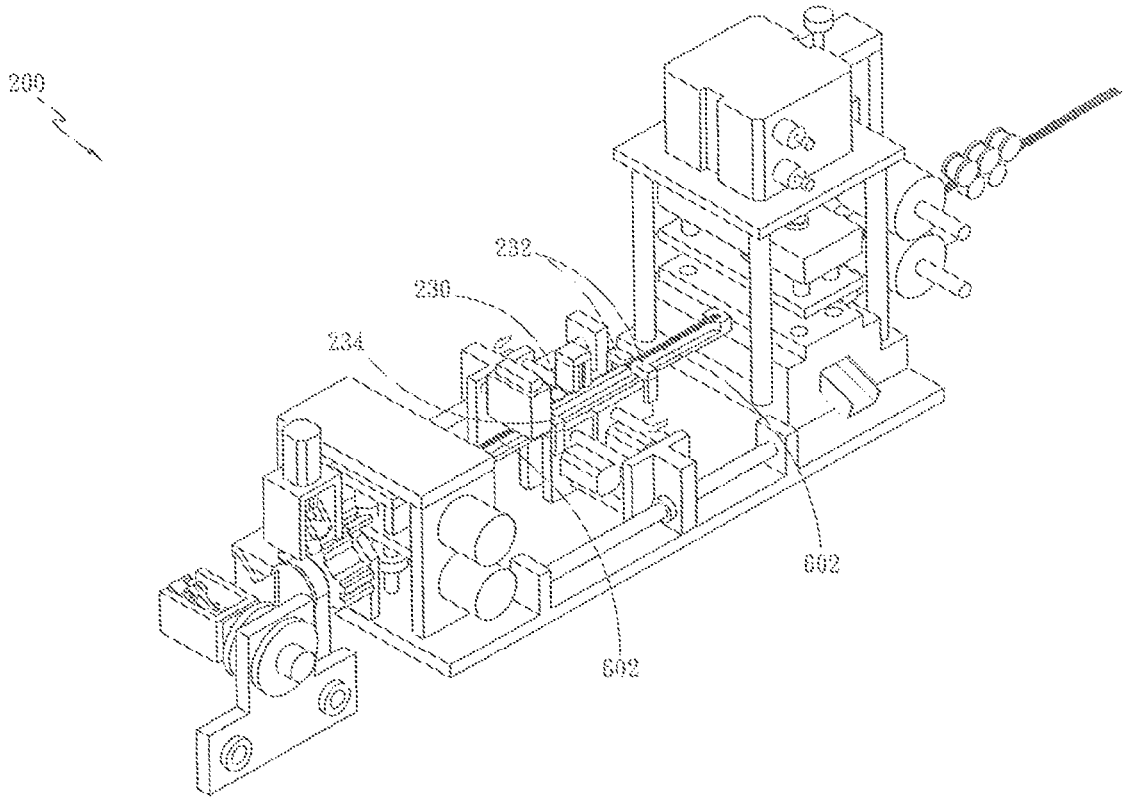
Figure 3A:
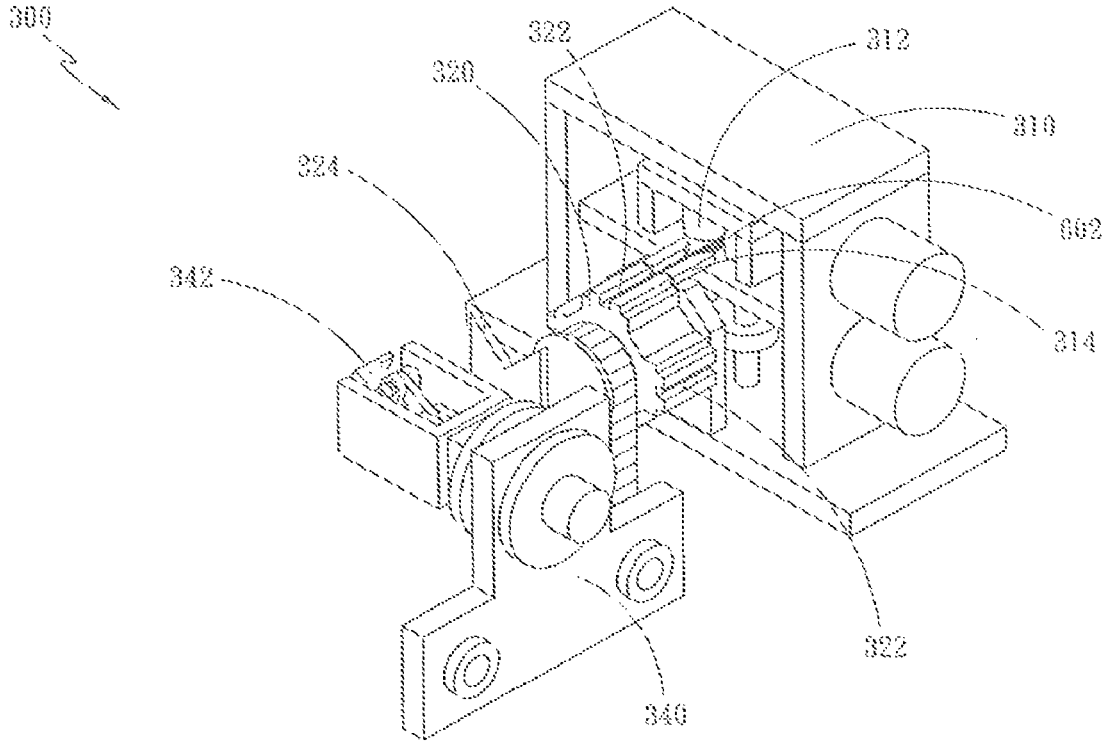
FIGS. 3A-3G are perspective views showing the operation of a nose strip turnover mechanism of the automatic nose strip bonding apparatus of the present invention.
Figure 3B:
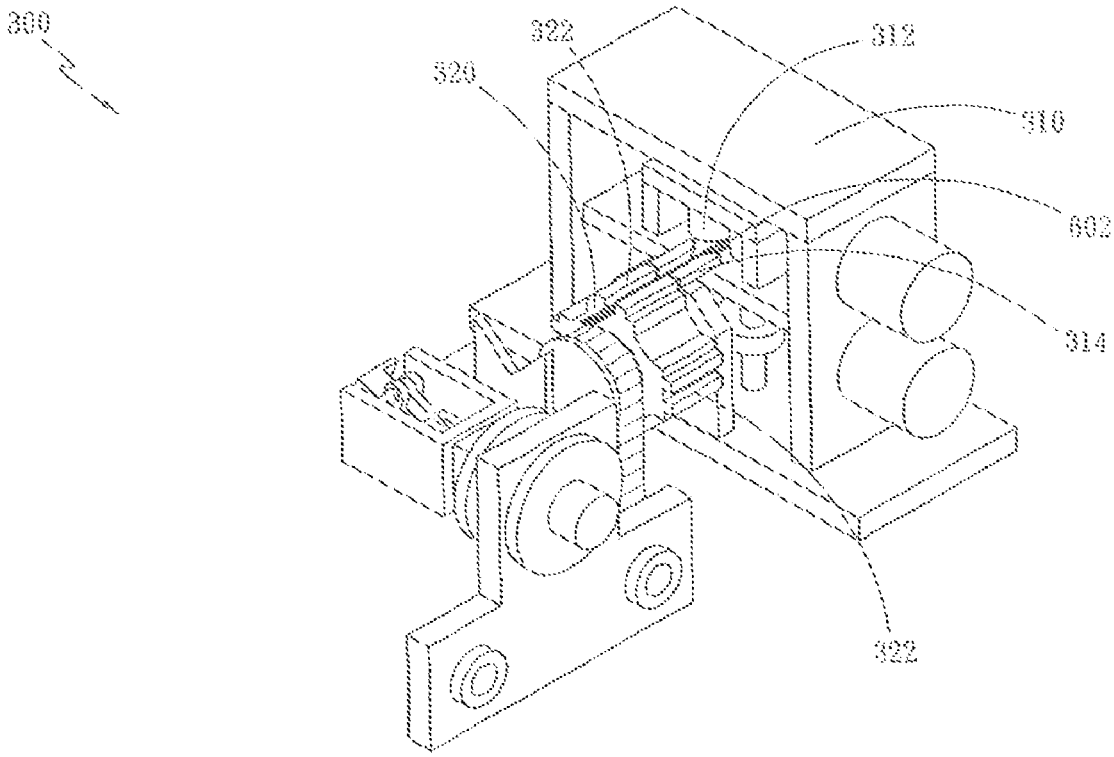
Figure 3C:
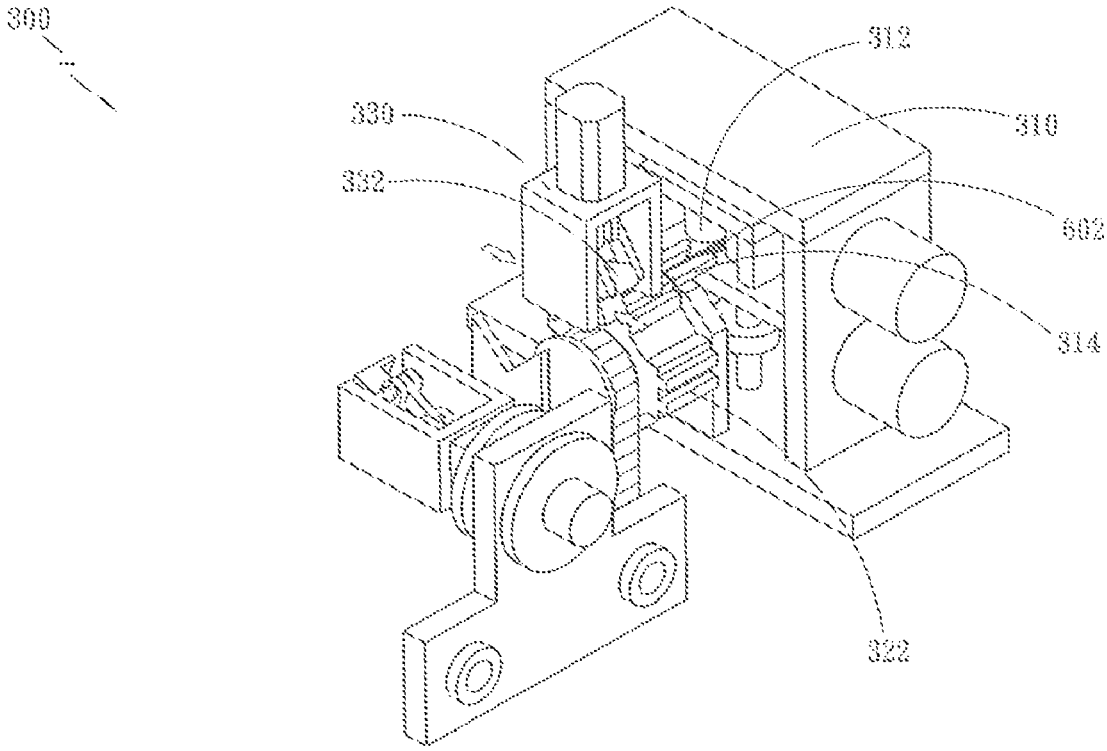
Figure 3D:
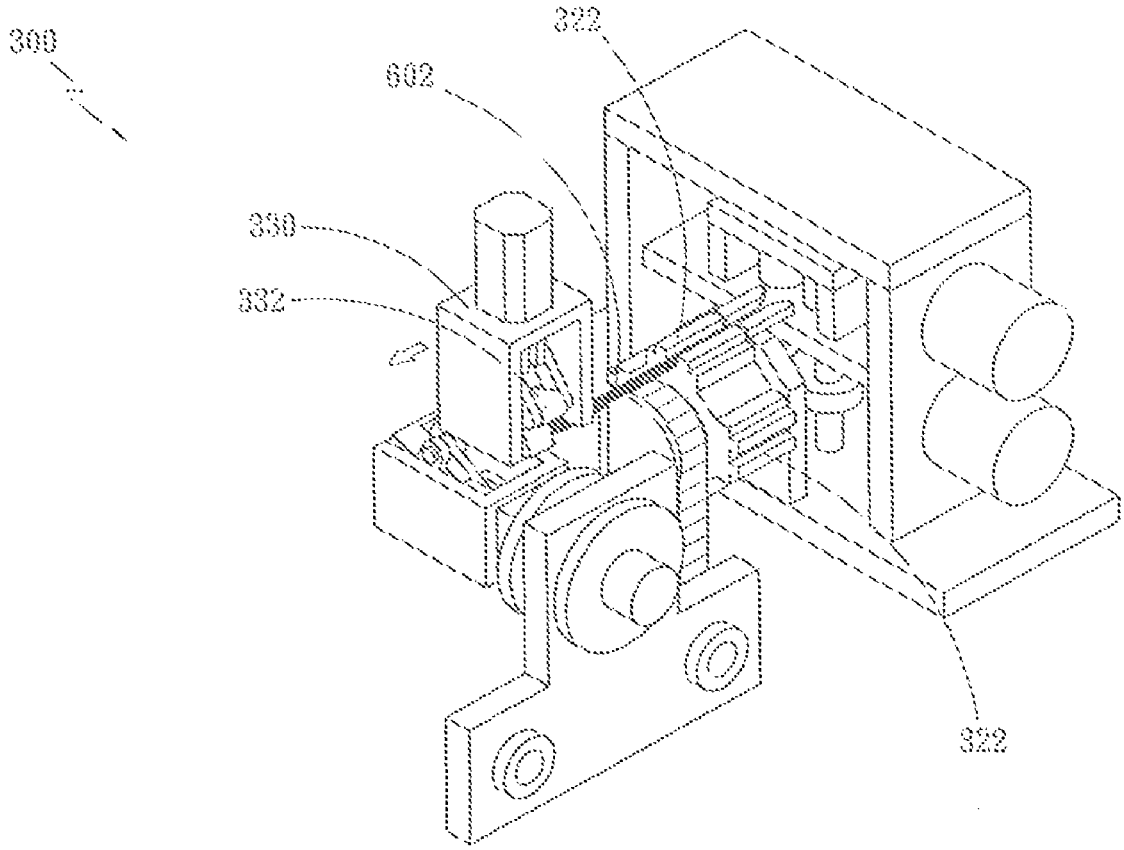
Figure 3E:
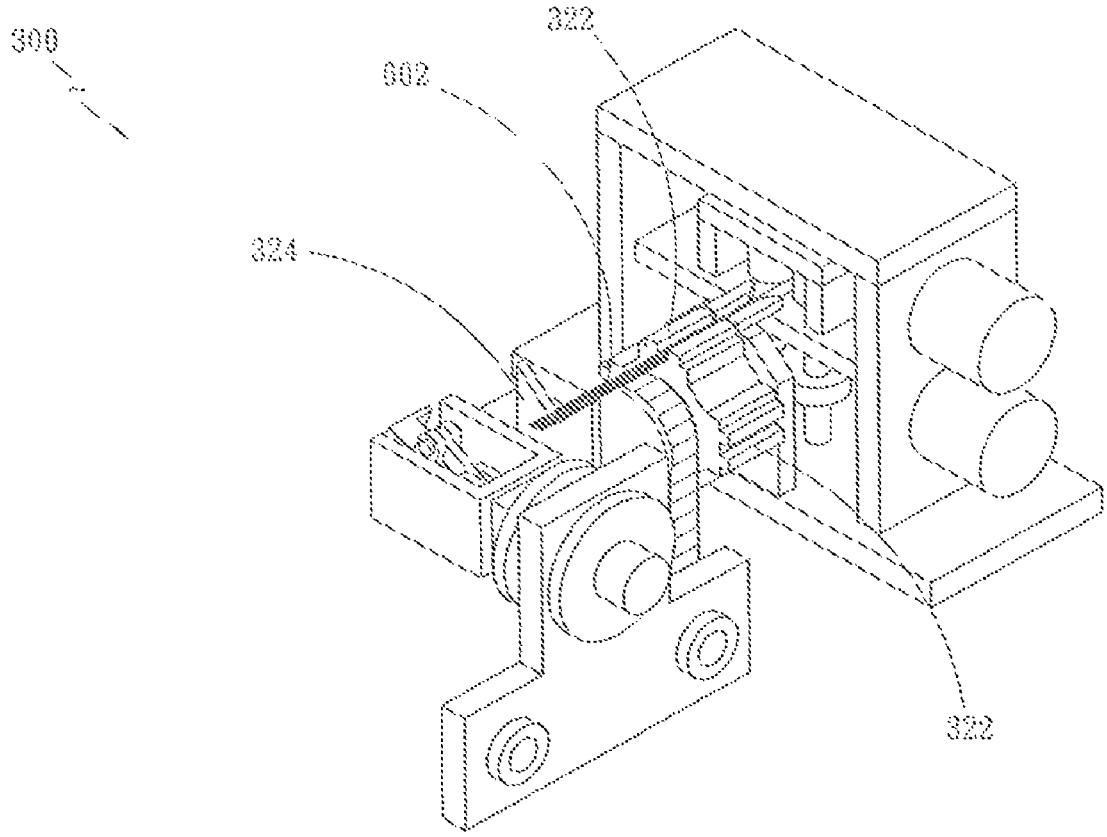
Figure 3F:
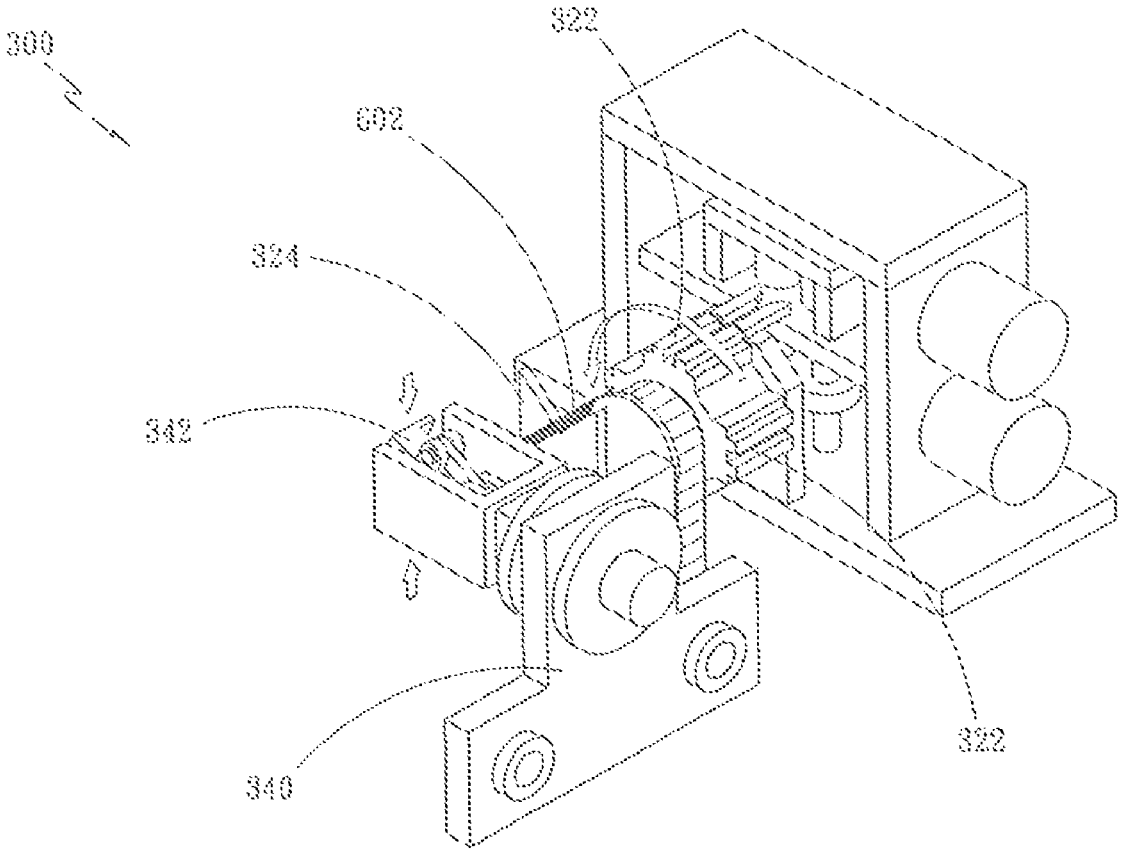
Figure 3G:
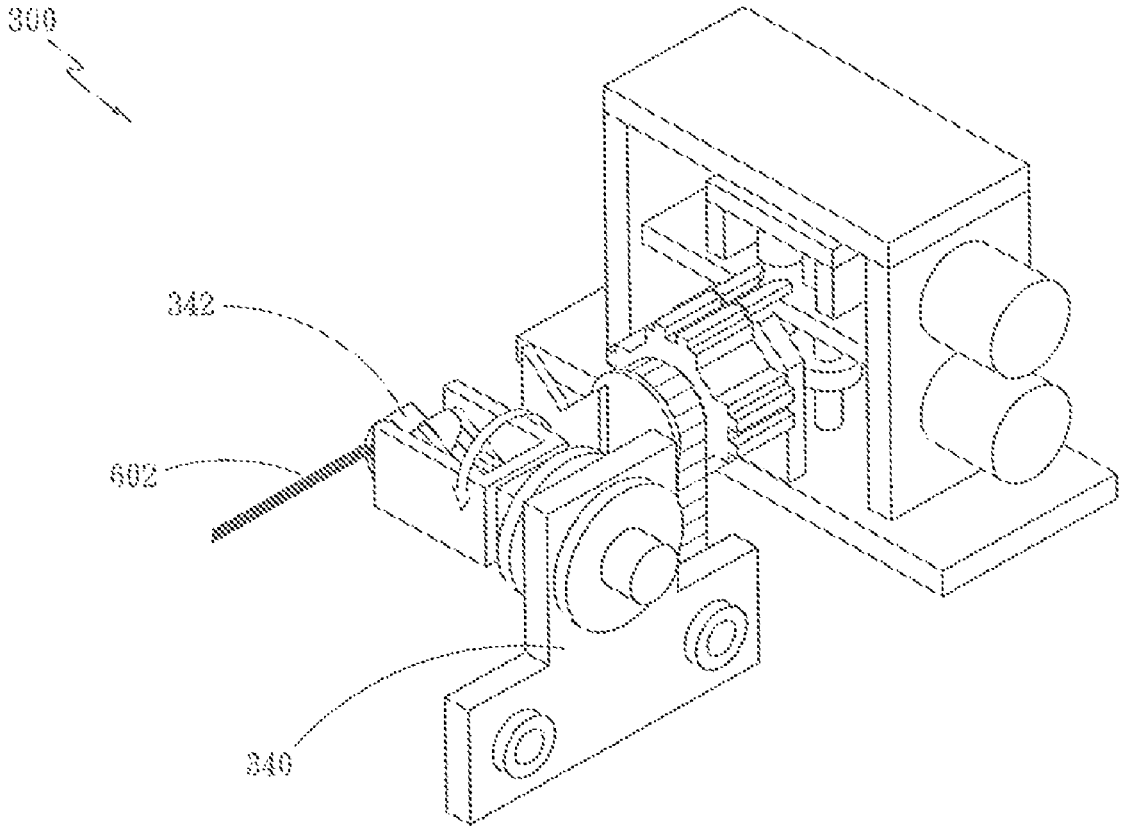

With reference to the drawings and in particular in FIG. 1, an automatic nose strip bonding apparatus constructed in accordance with the present invention, generally designate with reference numeral 100, comprises a nose strip providing mechanism 200, nose strip turnover mechanism 300, and a press-to-bond device. With such mechanisms and devices, a nose strip 602 is prepared and supplied, cut, coated with adhesive, and pressed to bond to a face mask 600 can be done in a single process.

Also referring to FIGS. 2A-2G, the nose strip providing mechanism 200 comprises at least one strip driving roller 210, a cutting module 220, a strip forwarding slider 230, and a bonding agent sprayer 250. The strip driving roller 210 drives the nose strip 602 forward to the cutting module 220, to a predetermined length, to allow the cutting module 220 to perform stamping operation over the nose strip 602. The cutting module 220 is provided with a chip chute 222 to discharge the chips generated in the stamping operation. The nose strip 602 is then further carried forward by the strip forwarding slider 230. When the nose strip 602 is moved through the bonding agent sprayer 250, a bonding agent is applied to the nose strip 602 to allow the nose strip 602 to be attached to the face mask 600. The nose strip forwarding slider 230 comprises a first stationary clamp 232, a second stationary clamp 234, and a strip positioner 240. The strip positioner 240 comprises a push rod 242. The first and second stationary clamps 232, 234 serve to hold the nose strip 602 in movement for facilitating movement of the nose strip 602 without falling and sliding. The push rod 242 of the nose positioner 240 serves to depress and hold the nose strip 602 for application of the bonding agent. When the operation of the nose strip providing mechanism 200, the nose strip 602, after subjection to a stamping operation, is applied with the bonding agent to facilitate the subsequent operation for pressing and bonding the nose strip to the face mask.

Referring to FIGS. 3A-3G, the nose strip turnover mechanism 300 comprises a strip pulling module 310, a first positioning rack 320, a reciprocating clamp 330, a second positioning rack 324, and a rotary clamp 340. The strip pulling module 310 comprises a strip pulling roller 312, which forwards the nose strip 602 that has been applied with the bonding agent. The first positioning rack 320 forms at least one channel 322, which is located behind the strip pulling roller 312 in the strip forwarding direction, whereby when the nose strip passes the strip pulling roller 312, the nose strip can be positioned in the channel 322 and partially projecting beyond the channel 322. A guide channel 314 is provided between the strip pulling roller 312 and the first positioning rack 320 to facilitate forwarding movement of the nose strip. The reciprocating clamp 330 comprises at least one fixed clip 332, which holds on a portion of the nose strip 602 that projects beyond the first positioning rack for driving the nose strip. When the reciprocating clamp 330 moves the noses strip 602 out of the first positioning rack 320, the first positioning rack 320 is rotated to allow the projecting portion of the nose strip to be positioned on the second positioning rack 324. The rotary clamp 340 is provided with at least one fixed clip 342 for holding the nose strip positioned on the second positioning rack 324, and the rotary clamp 340 then rotates and transfers the nose strip to a location in front of the press-and-bond device. With the nose strip turnover mechanism 300, the nose strip that has already been applied with the bonding agent is turned over to have the side thereof on which the bonding agent is applied face the face mask, as illustrated in FIG. 4A, to allow the subsequent operation to be carried out by the press-and-bond device.

Figure 4A:
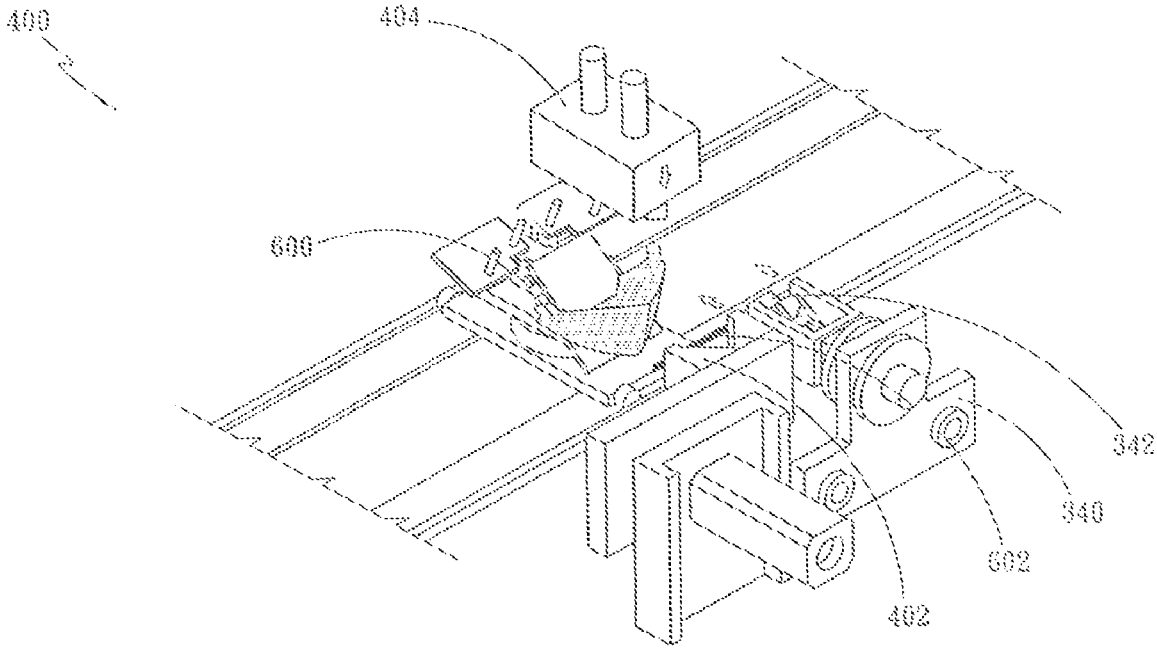
FIGS. 4A and 4B are perspective views showing the operation of a first bonding device of the automatic nose strip bonding apparatus of the present invention.
Figure 4B:
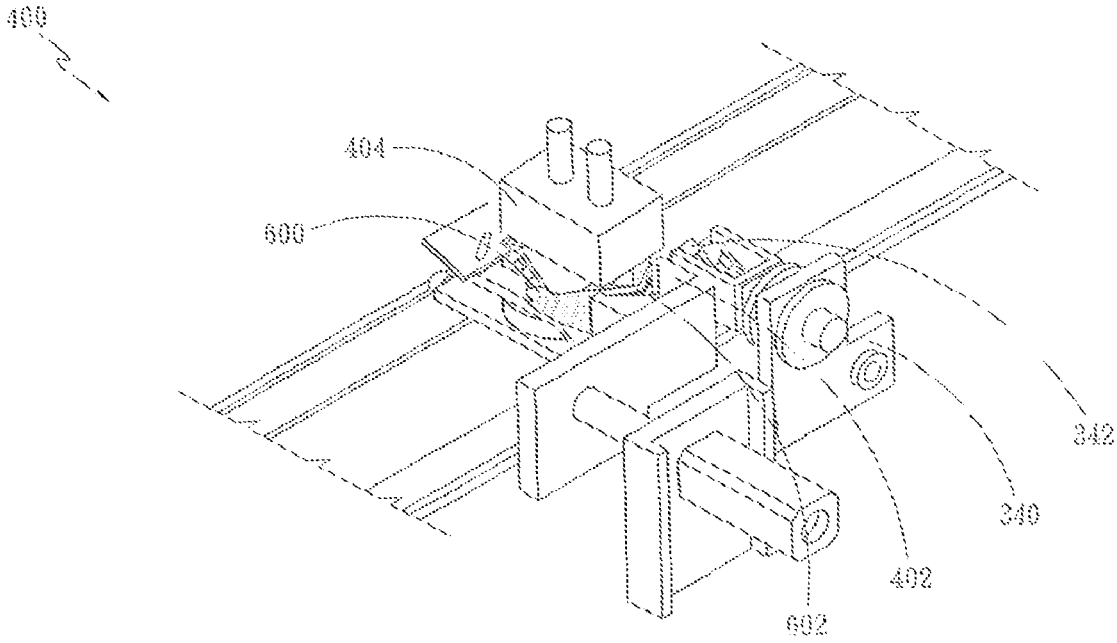
Figure 5:
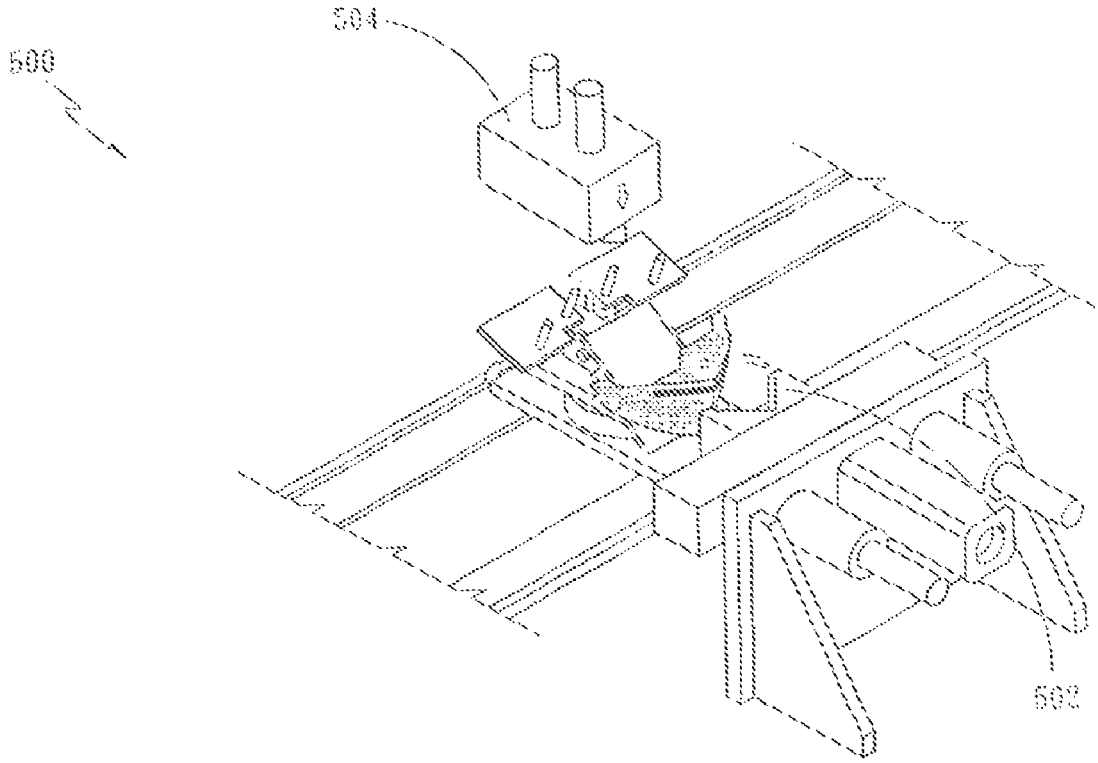
FIG. 5 is a perspective view illustrating the operation of a second bonding device of the automatic nose strip bonding apparatus of the present invention.
Figure 6:
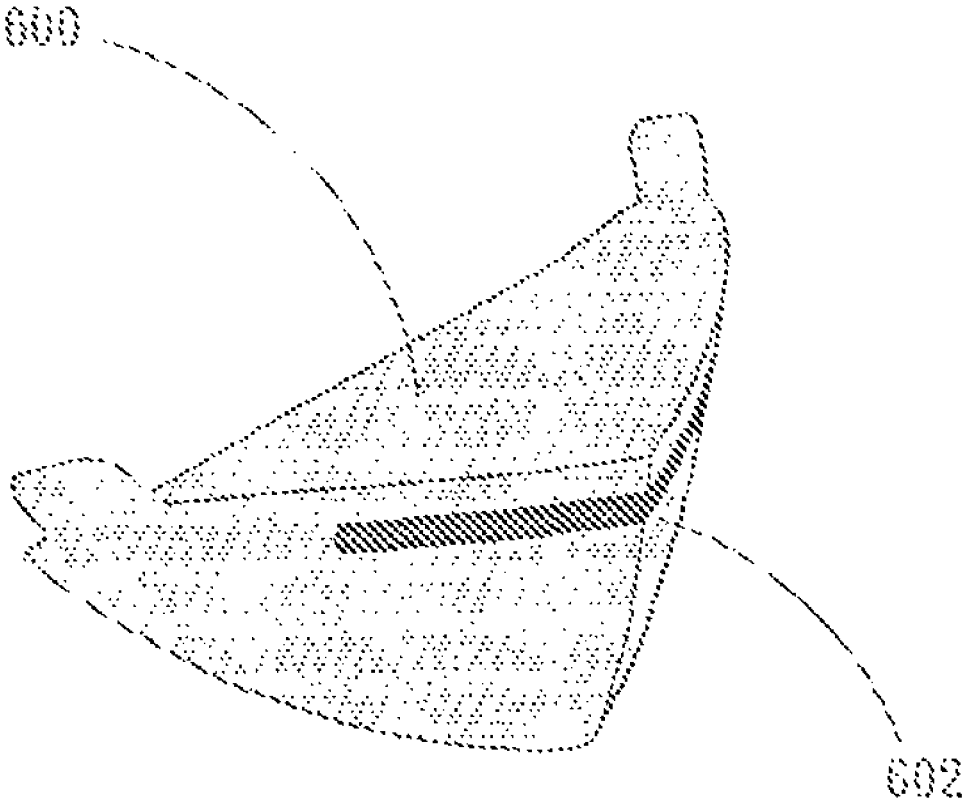
FIG. 6 is a perspective view illustrating a face mask manufactured with the automatic nose strip bonding apparatus of the present invention.

Referring to FIGS. 4A and 5, the press-and-bond device comprises a first bonding device 400 and a second bonding device 500. The first bonding device 400 comprises a first push board 402 and a first anvil 404 for attaching the nose strip to the face mask. The first push board 402 forms a V-shaped slot, while the first anvil 404 forms a V-shaped anvil corresponding to the V-shaped slot. The first push board 402 moves the nose strip toward and against the face mask 500, while the first anvil 404 moves downward to abut press against an inner side of the face mask to thereby force the face mask and the nose strip tightly against each other and thus attaching the nose strip to the face mask. The second bonding device 500 comprises a second push board 502 and a second anvil 504. The second push board forms a V-shaped slot, while the second anvil 504 forms a V-shape anvil corresponding to the V-shaped slot. Again, the second push board 502 moves toward and against the inner side of the face mask, while the second anvil 504 moves downward to press against the inner side of the face mask to once again have the nose strip pressed against the face mask to further securely fix the nose strip to the face mask. Thus, a face mask with a nose strip securely fixed thereto is formed as illustrated in FIG. 6.

Although the present invention has been described with reference to the preferred embodiment thereof, it is apparent to those skilled in the art that a variety of modifications and changes may be made without departing from the scope of the present invention which is intended to be defined by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An automatic nose strip bonding apparatus for a face mask comprising:

a nose strip providing mechanism comprising:

at least one strip driving roller that drives a nose strip forward;

a cutting module, which performs a stamping operation on the nose strip when the nose strip has forwarded a predetermined length;

a strip forwarding slider, which forwards the stamped nose strip;

a bonding agent sprayer, which applies a bonding agent to the nose strip; and a strip turnover mechanism, comprising:

a strip pulling module comprising a strip puling roller that forwards the nose strip that has been applied with the bonding agent;

a first positioning rack forming at least one channel located behind the strip pulling roller in the forwarding direction whereby when the nose strip passes the strip pulling roller, the nose strip is positionable in the channel and partially projecting beyond the channel;

a reciprocating clamp comprising at least one fixed clip, which is arranged behind the first positioning rack in the forwarding direction for holding on a portion of the nose strip that projects beyond the first positioning rack to move the nose strip out of the first positioning rack;

a second positioning rack, which receives the projecting portion of the nose strip after the reciprocating clamp moves the nose strip out of the first positioning rack and the first positioning rack is rotated; and a rotary clamp comprising at least one fixed clip for holding the nose strip positioned on the second positioning rack; and a press-to-bond device for bonding the nose strip comprising a first bonding device that comprises a first push board and a first anvil.

2. The automatic nose strip bonding apparatus as claimed in claim 1, wherein the strip forwarding slider comprises a first stationary clamp, a second stationary clamp, and a strip positioner.

3. The automatic nose strip bonding apparatus as claimed in claim 2, wherein the strip positioner comprises a push rod.

4. The automatic nose strip bonding apparatus as claimed in claim 1, wherein the cutting module comprises a chip chute.

5. The automatic nose strip bonding apparatus as claimed in claim 1, wherein the press-to-bond device further comprises a second bonding device, which comprises a second push board and a second anvil.

6. The automatic nose strip bonding apparatus as claimed in claim 1 further comprising a guide channel arranged between the strip pulling roller and the first positioning rack.

7. The automatic nose strip bonding apparatus as claimed in claim 1, wherein the first push board forms a V-shaped slot and wherein the first anvil comprises a V-shaped anvil corresponding to the V-shaped slot.

8. The automatic nose strip bonding apparatus as claimed in claim 5, wherein the first push board forms a V-shaped slot and wherein the first anvil comprises a V-shaped anvil corresponding to the V-shaped slot.

9. The automatic nose strip bonding apparatus as claimed in claim 5, wherein the second push board forms a V-shaped slot and wherein the second anvil comprises a V-shaped anvil corresponding to the V-shaped slot.

* * * * *